US005480324A

United States Patent [19]

Maegawa et al.

[11] Patent Number: 5,480,324

[45] Date of Patent: Jan. 2, 1996

[54] METHOD AND APPARATUS FOR VISIBLY INDICATING A PROPERLY FITTED CONNECTOR

[75] Inventors: Akihito Maegawa; Kiyofumi Ichida, both of Yokkaichi, Japan

[73] Assignee: Sumitomo Wiring Systems, Ltd., Mie, Japan

[21] Appl. No.: 281,178

[22] Filed: Jul. 27, 1994

[30] Foreign Application Priority Data

Jul. 28, 1993 [JP] Japan ..... 5-207245

[51] Int. Cl.[6] ..... H01R 3/00

[52] U.S. Cl. ..... 439/489; 439/352

[58] Field of Search ..... 439/350, 352–355, 439/357, 358, 372, 488, 489

[56] References Cited

U.S. PATENT DOCUMENTS

| | | | |
|---|---|---|---|
| 4,674,814 | 6/1987 | Hoshino et al. | 439/489 X |
| 4,884,978 | 12/1989 | Inaba et al. | 439/352 |
| 5,145,356 | 9/1992 | Minnis | 439/352 |
| 5,348,493 | 9/1994 | Power | 439/352 |

FOREIGN PATENT DOCUMENTS

| | | |
|---|---|---|
| 3839728 | 6/1989 | Germany . |
| 2-50981 | 4/1990 | Japan . |

*Primary Examiner*—Khiem Nguyen
*Attorney, Agent, or Firm*—Oliff & Berridge

[57] ABSTRACT

A cover for covering a lock arm is mounted through a self hinge portion on an upper surface of a female housing for pivotal movement between an open and a closed position, and a non-engagement detection projection is formed on a back surface of the cover at a proximal end portion thereof. When the cover is pushed by an operator to be closed, the lock arm slants forwardly upwardly with a hook portion placed on an engagement portion formed on a male housing. If the male and female housings are not engaged with each other, and therefore the non-engagement detection projection abuts against the lock arm, the cover is held in a raised condition thus indicating that the housings are not engaged with each other. Because the cover is mounted integrally on the housing, the number of the component parts is reduced, and extra management of the parts and extra assembling steps are eliminated.

18 Claims, 3 Drawing Sheets

METHOD AND APPARATUS FOR VISIBLY INDICATING A PROPERLY FITTED CONNECTOR

BACKGROUND OF THE INVENTION

This invention relates to a method of indicating a properly fitted connector and a connector that is releasably fitted on a mating connector and is maintained in engagement with the mating connector by a lock arm. More particularly, this invention relates to a connector having clearly visible structure for indicating whether two housings are completely engaged with each other.

One known connector having such an indicator is disclosed in Japanese Utility Model Unexamined Publication No. 2-50981.

In this connector, when a male connector housing b is fitted in a female connector housing a, which is connected to equipment (not shown) in a direction of an arrow 100 as shown FIG. 4(A), a lock arm c provided on the housing b is engaged with an engagement portion d provided on the female housing a, so that the two housings a and b are held in an engaged condition. A cover f is mounted on an upper surface of the female housing a for pivotal movement about a shaft h, and a detection portion g for abutting against a projection e formed on a rear end of the male housing b in the fitting direction is mounted on the cover f in a projected manner. The cover f is normally held in an upright posture (FIG. 4(A)) by a resilient force of a torsion coil spring i. In a non-engaged condition of the two housings a and b as shown in FIG. 4(B), when the cover f is pushed down after the male housing b is fitted, the detection portion g on the cover f abuts against the projection e on the male housing b, thereby detecting the fact that the two housings a and b are not engaged with each other.

However, in addition to the housing a, the detection device of the connector requires many component parts including the cover f, the shaft h, and the torsion coil spring i. Accordingly, the cost for this connector has been greatly increased, and the management of the component parts and the assembling operation have been cumbersome.

Another disadvantage is that because the cover f is mounted on the connector connected to the equipment, the construction of the equipment has been limited. For example, where a connector is integrally mounted on a small device such a relay, the overall size of the device is increased because of an increased size of the connector portion.

SUMMARY OF THE INVENTION

The present invention has been made in view of the above problems. In a first aspect of the invention, a connector is adapted to be releasably fitted relative to a mating connector. The connector comprises a lock arm mounted on a connector housing that is engageable with an engagement portion provided on a housing of the mating connector to hold the two housings in an engaged condition; a cover for covering the lock arm is mounted through a self-hinge portion on the connector housing for pivotal movement between an open position and a closed position; and a non-engagement detection projection for holding the cover in a raised position when the lock arm is not engaged, with the non-engagement detection portion being formed on at least one of the lock arm and the cover. The cover can be provided with a retaining portion for being engaged with the connector housing to hold the cover in such a condition that the cover covers the lock arm.

In another aspect of the invention, there is provided a connector comprising a housing, a lock arm pivotably engaged with the housing, said lock arm including a hook portion adapted to engage with an engagement portion of a mating connector, a cover pivotably mounted on the housing, and a non-engagement detection projection mounted on at least one of said cover and said lock arm for providing interference between said cover and said lock arm when the connector is not properly fitted with the mating connector.

In another aspect of the invention, there is provided a method of connecting first and second connectors and visually indicating a properly connected condition, the first connector including a housing having a pivotable cover and a lock arm that includes a hook portion engageable with an engagement portion formed on the second connector, the method comprising the steps of: sliding the first and second connectors together so as to make contact between the hook portion and the engagement portion; pivoting the cover relative to the housing; engaging the cover and the lock arm in an interfering manner to indicate an incomplete connection when the first and second connectors are not fully engaged; and connecting a distal end of the cover with the housing to indicate a complete connection when the first and second covers are fully engaged.

In still yet another aspect of the present invention, there is provided a connector comprising a housing having a pivotably mounted lock arm and a cover, the lock arm including a hook portion that is engageable with an engagement portion formed on a mating connector, and means for visually indicating an incomplete connection by providing interference between the cover and the lock arm when the connector is not properly fitted with the mating connector.

The operation of the invention is as follows: After the connector is fitted on the mating connector, the cover is closed to cover the lock arm, and at this time if the lock arm is not engaged with the engagement portion, the non-engagement detection projection, formed on at least one of the lock arm and the cover, functions to hold the cover in a raised condition, that is, a non-fully closed condition, and this visually indicates the fact that the two housings are not completely engaged with each other. When the cover is closed, the retaining portion holds the cover in such a condition that the cover covers the lock arm, if the two housings are in the engaged condition.

With this construction, by merely closing the cover, it can be positively and visually judged whether or not the two housings are brought into engagement with each other. Because the cover is integrally mounted on the housing through the self hinge portion, manufacturing costs can be decreased in contrast with the conventional construction in which separate parts are required. In addition, some component parts and assembling operation steps can be eliminated.

This construction is provided on the connector adapted to be connected to the connector connected to the equipment, and therefore there are achieved advantages that the connector connected to the equipment is not increased in size, and that the construction of the equipment is not limited.

Because the cover is held in the condition in which it covers the lock arm, it can be positively confirmed that the detection operation for determining whether or not the two housings are in the engaged condition has been completed.

BRIEF DESCRIPTION OF THE DRAWINGS

This invention will be described with reference to the following drawings, wherein.

DETAILED DESCRIPTION OF PREFERRED EMBODIMENTS

One preferred embodiment of the present invention will now be described with reference to FIGS. 1 to 3.

Figure 1:
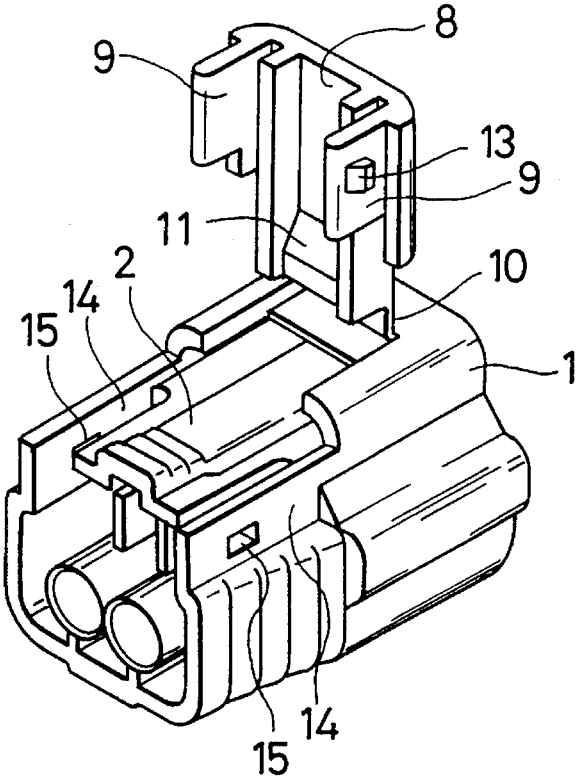
FIG. 1 is a perspective view of one preferred embodiment of the present invention.
Figure 2:
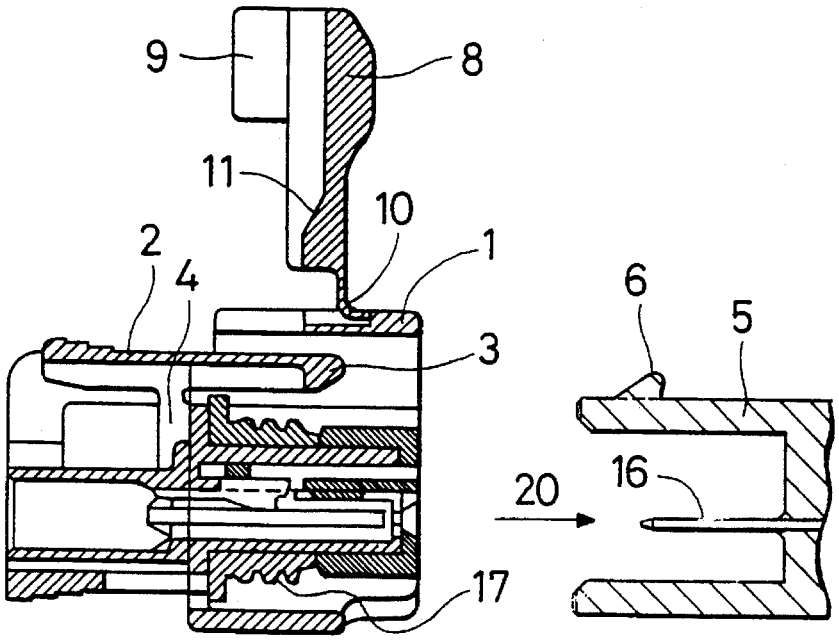
FIG. 2 is a cross-sectional view of the present invention.

In FIGS. 1 and 2, a female connector housing 1 is made of a synthetic resin. A lock arm 2 having a hook portion 3 at its front end is provided at an upper side of the housing 1 and extends horizontally in a direction of the length of the housing 1, the lock arm 2 being resiliently rockable about a fulcrum 4 formed on a central portion of the lock arm's lower surface in the direction of its length. When the female housing 2 is fitted on a male connector housing 5 of a synthetic resin, which in turn, is connected to equipment, in a direction of an arrow 20 in FIG. 2, the hook portion 3 of the lock arm 2 is brought into engagement with an engagement portion 6 formed on an upper surface of the male housing 5, and the lock arm 2 is pushed to swing in such a manner that its front end moves upward, and when the hook portion 3 passes past the engagement portion 6, the lock arm 2 is restored into a horizontal posture by its own resilient force. Accordingly, the hook portion 3 is retained on the engagement portion 6, thereby holding the two housings 1 and 5 in an engaged condition against withdrawal.

A cover 8 is pivotally mounted on the upper surface of the female housing 1 by a self hinge portion 10 so as to cover the upper surface of the lock arm 2, the cover 8 having side plates 9 disposed respectively on right and left sides of the rear end portion of the lock arm. In the molding of the female housing, the cover is disposed in an open position, that is, perpendicular to this housing. A non-engagement detection projection 11 is formed on a back surface of the cover 8 at a proximal end portion thereof registrable with the front end portion of the lock arm 2.

A pawl 13 is formed on each of the right and left side plates 9 of the cover 8, and a retaining hole 15 is formed through each of right and left side walls 14 of the housing 1. When the cover 8 is closed to be disposed in a horizontal posture, the pawls 13 are engaged in the retaining holes 15, respectively.

Male terminals 16 are provided in the male connector housing 5 as shown in FIG. 2, and female terminals (not shown) for receiving the male terminals 16 are provided in the female housing 1. A waterproof packing 17 for fitting in the male housing 5 is provided in the female housing 1.

This embodiment has the above construction, and its operation will now be described.

Figure 3A:
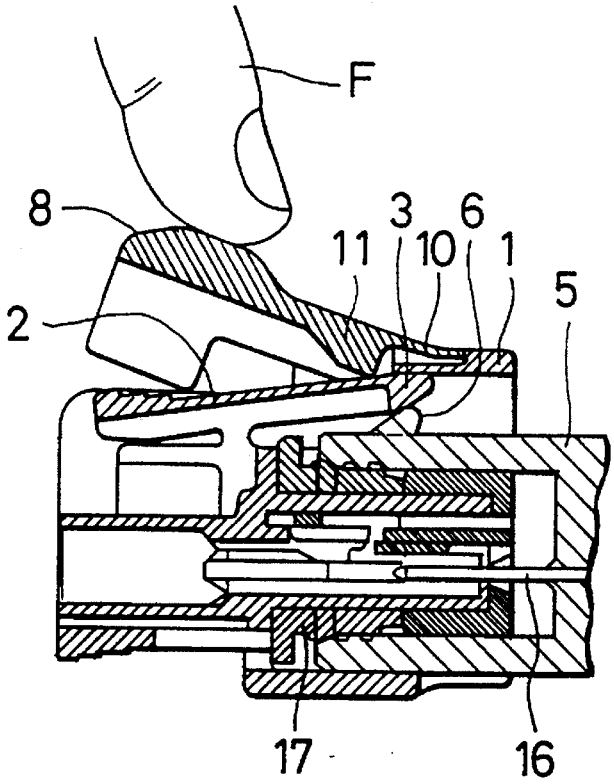
FIGS. 3(A) and 3(B) are illustrations explanatory of the detection operation, FIG. 3(A) being a cross-sectional view showing a non-engaged condition of two housings, and FIG. 3(*b*) being a cross-sectional view showing an engaged condition of the two housings.

The female housing 1 is fitted on the male housing 5 as described above, and the cover 8 is pushed down by a user's finger F from its open position toward its closed position as shown in FIG. 3(A). At this time, if the two housings 1 and 5 are in the non-engaged condition, the lock arm 2 is slanting forwardly upwardly with the hook portion 3 placed on the engagement portion 6, as shown in FIG. 3(A). Therefore, the non-engagement detection projection 11 of the cover 8 is engaged with the upper surface of the lock arm 2 at its front end portion, so that the cover 8 is held in a raised condition, and hence can not be fully closed.

Thus, the non-engaged condition of the two housings 1 and 5 is detected, and the operator need only to further push the female housing 1 to complete the engagement.

Figure 3B:
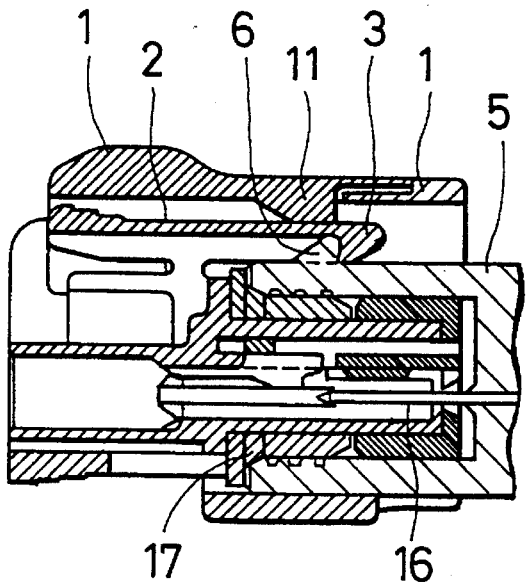
Figure 4A:
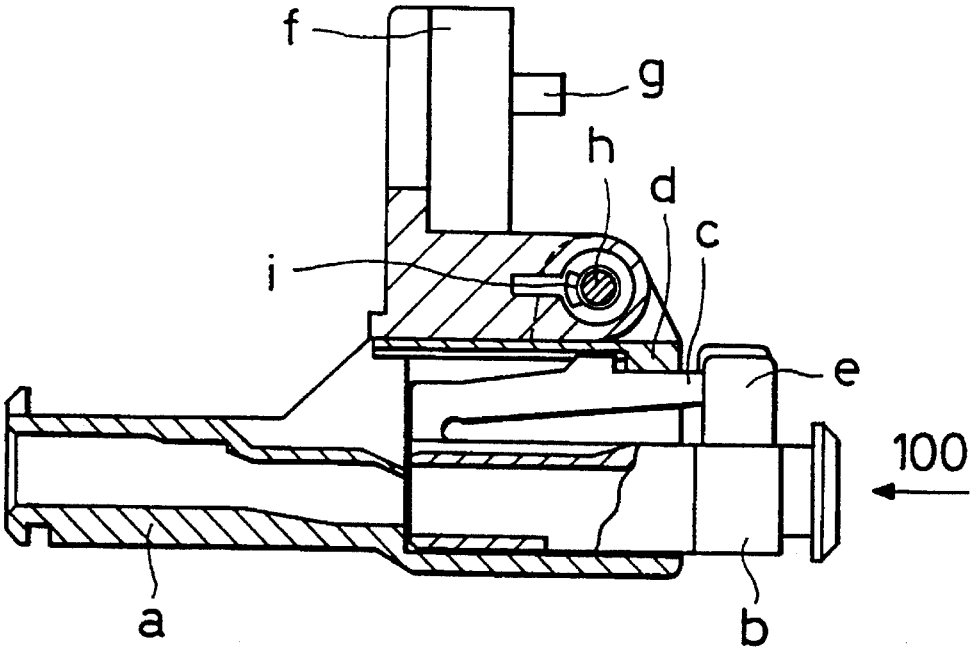
FIG. 4(A) RELATED ART
FIGS. 4(A) and 4(B) are cross-sectional views of a conventional construction.
Figure 4B:
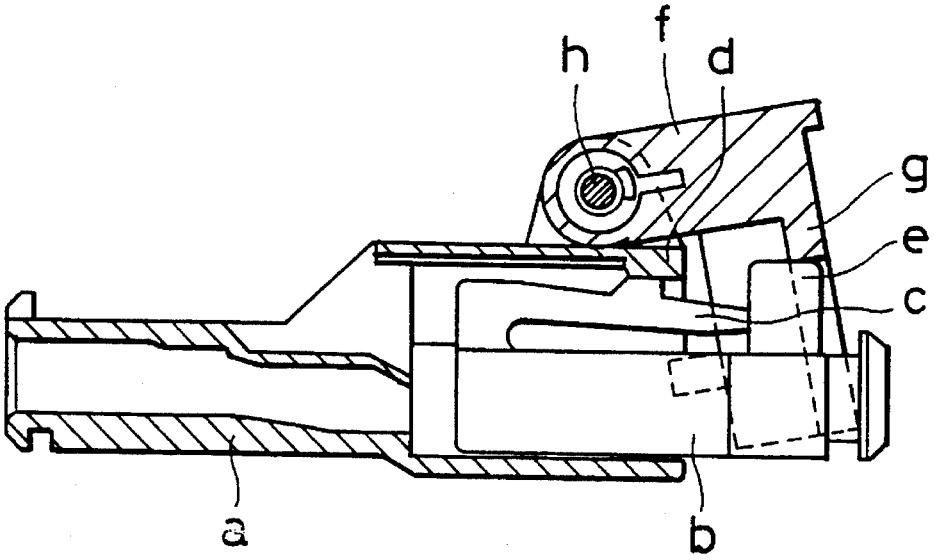
FIG. 4(B) RELATED ART

When the two housings 1 and 5 are completely engaged with each other either by thus pushing the female housing 1 again or by the first fitting operation, the lock arm 2 is disposed in a horizontal posture with its hook portion 3 retained on the engagement portion 6 as shown in FIG. 3(B), and therefore the cover 8 can be fully closed without abutment of the non-engagement detection projection 11 against the lock arm 2, and from this condition, the engaged condition of the two housings 1 and 5 is detected.

At this time, the pawls 13 of the side plates 9 of the cover 8 are fitted respectively in the retaining holes 15 in the side walls 14 of the housing 1, thereby holding the cover in its closed position, and it can be confirmed from this that the detection operation for determining whether or not the two housings 1 and 5 are in the engaged condition has been completed.

Thus, in this embodiment, by merely closing the cover 8, it can be easily judged whether or not the two housings 1 and 5 have been brought into engagement with each other. Moreover, because the cover 8 is integrally mounted on the housing 1 through the self hinge portion 10, the number of the component parts is not increased, thus preventing the cost from being increased, and extra management of the component parts and extra assembling operations can be eliminated.

Furthermore, because the cover 8 is provided not on the connector connected to the equipment, but on the connector for fitting on the equipment-side connector, the construction of the equipment is not limited, and this construction is suited for a connector to be fitted on a connector integrally incorporated, for example, in a relay.

Incidentally, the provision of the non-engagement detection projection 11 is not limited to the back surface position of the cover 8 in the above embodiment, and the projection may be provided at a position on the upper surface of the lock arm 2, or may be formed on each of the cover and the lock arm.

The invention has been described with reference to preferred embodiments thereof, which are intended to be illustrative but not limiting. Various modifications may be made without departing from the spirit and scope of the invention as set forth in the appended claims.

What is claimed is:

1. An electrical connector adapted to be releasably fitted relative to a mating electrical connector, comprising a connector housing having a lock arm that is engageable with an engagement portion provided on a mating housing of said mating connector to hold the connector and mating housings in an engaged condition when the mating connector housing is engaged with the connector housing; a cover for covering said lock arm mounted through a self-hinge portion on said connector housing for pivotal movement between an open position and a closed position; and a non-engagement detection projection for maintaining said cover in a raised position when said lock arm is not engaged, said non-engagement detection projection being formed between said lock arm and said cover.

2. A connector of claim 1, wherein said cover is provided with a retaining portion that is engageable with said connector housing to hold said cover in such a condition that said cover covers said lock arm.

3. An electrical connector comprising:

a housing;

a lock arm pivotably connected to said housing, said lock arm including a hook portion adapted to engage with an engagement portion of a mating electrical connector when the mating connector is engaged with the housing;

a cover pivotably mounted on said housing; and a non-engagement detection projection mounted between said cover and said lock arm for providing interference between said cover and said lock arm when the connector is not properly fitted with said mating connector.

4. The connector of claim 3, wherein said lock arm is pivotably mounted on a fulcrum located on said housing.

5. The connector of claim 3, wherein said engagement portion and said hook portion of said lock arm each includes a first inclined surface and a second inclined surface, and said interference is provided when said inclined surfaces are engaged.

6. The connector of claim 5, wherein a fully connected position is achieved when said inclined surfaces disengage and said second surfaces engage, thereby preventing said interference between said cover and said lock arm.

7. The connector of claim 3, wherein said non-engagement detection projection is formed on said cover.

8. The connector of claim 3, wherein said cover is pivotably connected to said housing with a self-hinge that biases the cover to an open position.

9. The connector of claim 3, wherein the cover includes at least one retaining portion having a retaining pawl that is engageable with a retaining hole formed in said housing when said cover and said lock arm do not interfere.

10. A method of connecting first and second electrical connectors and visually indicating a properly connected condition, the first connector including a housing having a pivotable cover and lock arm that includes a hook portion engageable with an engagement portion formed on said second connector, said method comprising the steps of:

sliding the first and second connectors together so as to make contact between the hook portion and the engagement portion;

pivoting said cover relative to said housing;

engaging the cover and the lock arm in an interfering manner to indicate an incomplete connection when the first and second connectors are not fully engaged; and connecting a distal end of the cover with the housing to indicate a complete connection when the first and second connectors are fully engaged.

11. The method of claim 10, wherein the distal end of the cover includes retaining portions having locking pawls that are engageable with corresponding retaining holes formed in the housing, and the connecting step includes inserting the locking pawls in the retaining holes to maintain the indication of a complete connection.

12. The method of claim 10, wherein the pivoting step includes pivoting the cover about a self-hinge member mounted to said housing.

13. The method of claim 10, further comprising providing the cover with a non-engagement detection portion and the step of engaging includes engaging the non-engagement detection portion with the hook portion to indicate said incomplete connection.

14. An electrical connector comprising a housing having a lock arm and a cover pivotably mounted on the housing, said lock arm including a lock portion that is engageable with an engagement portion formed on a mating electrical connector when the mating connector is engaged with the connector housing, and means for indicating an incomplete connection and for providing interference between said cover and said lock arm when the connector is not properly fitted with said mating connector.

15. The connector of claim 14, wherein said means includes a non-engagement detection portion formed between said cover and said lock arm for urging said cover in an open position to indicate said incomplete connection.

16. The connector of claim 1, wherein said non-engagement detection projection is formed on said cover.

17. The connector of claim 3, wherein said non-engagement detection projection is formed on said cover.

18. The connector of claim 15, wherein said non-engagement detection projection is formed on said cover.

* * * * *